US005373664A

United States Patent [19]

Butler

[11] Patent Number: 5,373,664

[45] Date of Patent: Dec. 20, 1994

[54] SELF-CONTAINED AUTOMATIC GATE SYSTEM

[76] Inventor: Colin Butler, Main Street, Putney, Vt. 05346

[21] Appl. No.: 987,624

[22] Filed: Dec. 9, 1992

[51] Int. Cl.[5] ..... E05F 15/00

[52] U.S. Cl. ..... 49/358; 49/25

[58] Field of Search ..... 49/358, 27, 25, 13, 49/324, 334

[56] References Cited

U.S. PATENT DOCUMENTS

| | | | |
|---|---|---|---|
| 1,631,416 | 6/1927 | Howard | 49/358 |
| 2,561,623 | 7/1951 | Hall | 49/334 |
| 3,301,313 | 1/1967 | Schurink | 49/358 X |
| 3,398,484 | 8/1968 | Katsumura et al. | 49/358 X |
| 3,653,154 | 4/1972 | Hayday | 49/358 X |
| 4,658,543 | 4/1987 | Carr | 49/25 X |
| 4,699,197 | 10/1987 | Hamrick et al. | 49/334 X |
| 4,850,094 | 7/1989 | Lybecker | 49/358 X |
| 5,035,082 | 7/1991 | Butler | 49/334 |
| 5,101,595 | 4/1992 | Rhoades | 49/334 X |

FOREIGN PATENT DOCUMENTS

| | | | |
|---|---|---|---|
| 2410114 | 7/1979 | France | 49/358 |
| 2453965 | 12/1980 | France | 49/358 |
| 473698 | 3/1929 | Germany | 49/358 |

*Primary Examiner*—Peter M. Cuomo
*Assistant Examiner*—Jerry Redman
*Attorney, Agent, or Firm*—Nolte, Nolte and Hunter

[57] ABSTRACT

A self-contained automatic gate system is disclosed wherein all system components are built into the gate system itself thereby allowing the user to simply provide a footing for mounting the system and then mounting it with no need for further assembly.

15 Claims, 4 Drawing Sheets

SELF-CONTAINED AUTOMATIC GATE SYSTEM

BACKGROUND OF THE INVENTION

The present invention relates to an automated gate system of modular design which permits installation of the gate by simply providing a concrete footing and mounting the gate in which all of the systems for operating the gate are supported.

In particular, the invention relates to such a gate system especially suitable for residential use and incorporating designs having external architectural niceties coupled with internal support for gate operating components and securement of the gate upon a standardized gate post.

The invention further relates to such a gate system in which conventional hinging of the gate to the post is eliminated.

There have been a number of efforts at designing automatic gate systems. One, directed toward meeting the needs of those residing where commercial electricity is not economically available is disclosed in Lybecker, et al., U.S. Pat. No. 4,416,085 in which all of the power and activating components including a solar panel, a control box, and a separately mounted hydraulic cylinder are located externally of the post and gate to take advantage of the mechanical linkage, and solar source positioning, required for operational efficiency.

Holloway, U.S. Pat. No. 4,520,592 provides a more compact design with a rather cumbersome construction including a motor and wheel system which attaches onto the distal end of an existing gate to roll it open and shut.

Reid, U.S. Pat. No. 4,503,723, like Lybecker '085, discloses externally mounted apparatus for opening and closing a gate through a linkage.

Lybecker, U.S. Pat. No. 4,638,597, improved his earlier patent by supplying a bracket that incorporated the gate post.

Court, et al. , U.S. Pat. No. 4,750,295 and Gaddis, U.S. Pat. No. 4,782,628, generally follow in the same vein, each having remotely mounted control devices and solar cells opening and closing a gate through an extended mechanical linkage.

Although these prior art efforts attempted to provide ease of installation, they generally suffer two major drawbacks. First, the multiplicity of modules and mechanical linkages make installation time-consuming and complex. Second, the operating components are exposed to tampering, dust contamination, and the elements.

Carr, U.S. Pat. No. 4,658,543 discloses a gate actuator and other operational elements secured along the side of a post which is embedded in, and integral to, a concrete footing, the gate being conventionally hinged to the actuator for lifting the gate.

Hall, U.S. Pat. No. 4,665,650, has a conventional gate strapped to the cam follower of the actuator, the inner support member of which is embedded in concrete. Hall's invention is in a lift and rotate actuator and suggests the support of other operational elements within the confines of the actuator.

Butler, U. S. Pat. No. 4,916,859, incorporated the actuator within the gate post, anticipating the ramming of the separate gate by terrorists.

Sawyer, U.S. Pat. No. 2,311,967, is also concerned with impact of vehicles on his gate and provides his operational mechanisms atop the gate post to which the gate is conventionally hinged.

There are several major drawbacks to the concept of housing the actuator and other operating elements of automatic gates in the gate post and conventionally securing the gate to the post and/or actuator. The first is that severe impact damage to the post requires replacement of both the post and the footing. Secondly, and more importantly, the components inside the post are next to impossible to access for repair and maintenance without a major disassembly operation. Also, more complex control systems require ever increasing post dimensions within which to fit them. Hence, the supplier would either have to manufacture relatively mamouth standard post diameters to accommodate the possibility that a customer may wish to upgrade the system and add components, thereby wasting materials, or the supplier would have to sell differently dimensioned posts in accordance with system complexity, thereby requiring the purchaser to purchase an entirely new post unit should he desires to upgrade. Further, fabrication and assembling and then installation of the complex and cumbersome post is time consuming and labor intensive at both the assembling and installation stages.

The present invention eliminates these problems by standardizing the post unit and providing support for the electromechanical control systems within the gate module itself designed with ample and generous dimensions for housing the control systems and incorporating an integral gate post housing surrounding the post.

OBJECTS OF THE INVENTION

It is an object of this invention to provide an automated gate system in which the operative components of the system are built into the gate thereby providing modularility of design, ease of fabrication installation and access after installation, security against tampering, and protection from the elements.

It is an object of the invention to provide the sides of the gate with architectural niceties with the space between the sides dimensioned to provide support for the operational components of the gate.

It is an object of the invention to construct an integral end of the gate to house the gate post around which the gate will rotate, thus eliminating conventional hinging. It is an object of the invention to mount the gate actuator within the confines of the gate; preferably within the integral post housing as a direct support of the gate. In this respect, the invention contemplates the rotation of the actuator with the gate.

It is a further object of this invention to provide a solar collector to charge a battery power source within the gate as protection against external power failure and which operates at a safe voltage, thereby eliminating the possibility of fatal accidental shock. In this respect, it is contemplated within the invention to use the solar collector as an architectural feature at the side of the gate.

It is a further object of this invention to provide a gate system which is easily operable with a two-button control panel; one a control to open and close, the other an emergency stop.

It is another object of this invention to provide, as an option, a microprocessor-controlled automation system to allow remote gate control, to activate indicator and traffic control lights, to monitor safety sensors, and to report the results of internal systems diagnosis.

It is another object of this invention to encase the system components in plastic to provide reliability over a wide range of environmental conditions.

DETAILED DESCRIPTION OF THE DRAWINGS

Figure 1:
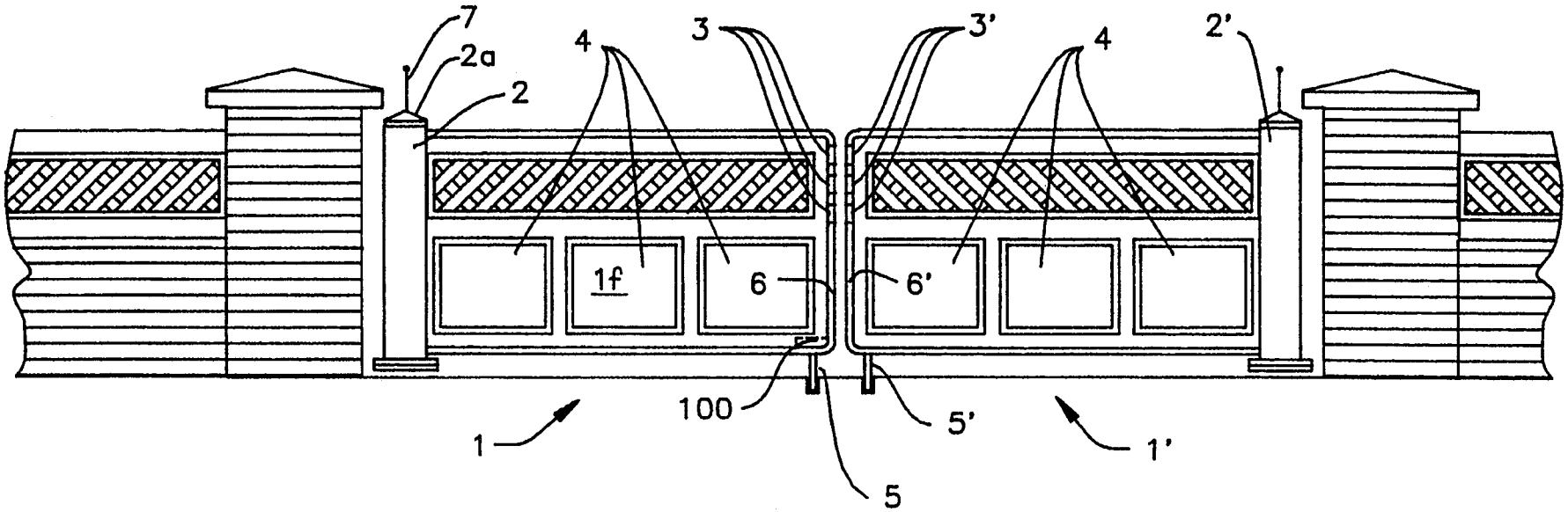
FIG. 1 a front elevational schematic view of a dual gate installation.

Referring to FIG. 1, an installed dual gate system is shown comprising a pair of gates 1, 1' having integral post housings 2, 2' at their proximal ends, traffic signals 3, 3' at their distal ends and solar panels 4, 4' positioned along the front sides of the gates. Lock rods 5, 5' are provided at the lower edges of the distal ends of the gates and sensor bars 6, 6' extend vertically at the distal edges of the gates. An antenna 7 is positioned in FIG. 1 atop the post housing access cover 2*a*.

Both gates incorporate the inventions described herein with reference to gate 1.

The front side 1*f* and rear side 1*r* extend from the proximal edge to the distal edge of the gate 1. The proximal end wall 1*e* and an inner strenghtening wall 1*i*, together with the proximal ends of the front side and rear side form an integral post housing.

Figure 3:
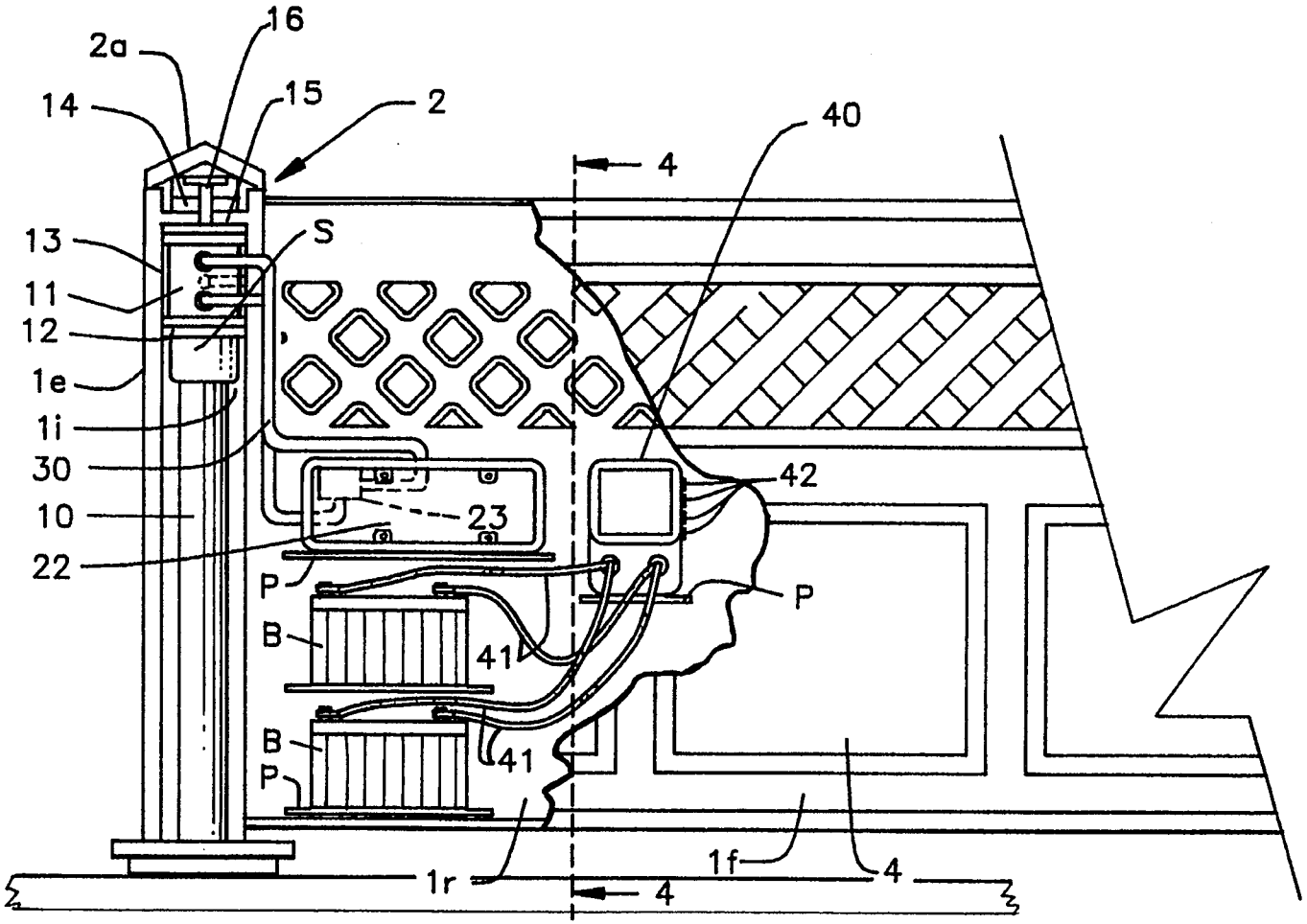
FIG. 3 is a schematic plan view partially cut away of a post and gate assembly of FIG. 1.

As seen in FIG. 3, the integral post housing 2 surrounds the post 10 atop which is positioned the gate actuator 11 which is rotationally mounted on mounting plate 12 secured to the top of the post. The post housing 2 of the gate 1 at its upper portion surrounds the actuator 11. The actuator is secured to the post housing for rotation with the actuator by bolts 14 through annulus 15. Annulus 15 may be made integral with the post housing or fitted for facile manufacture or access and removal. Annulus 13, here shown integral with the gate housing slip fits around the actuator as a support and stabilizer fitting. A setting knob 16 extends from the actuator. A gate position sensor S bridges the stable mounting plate and rotational body of the actuator 11 and is secured to the mounting plate.

An access cover 2*a* covers the top of the post housing.

Figure 4:
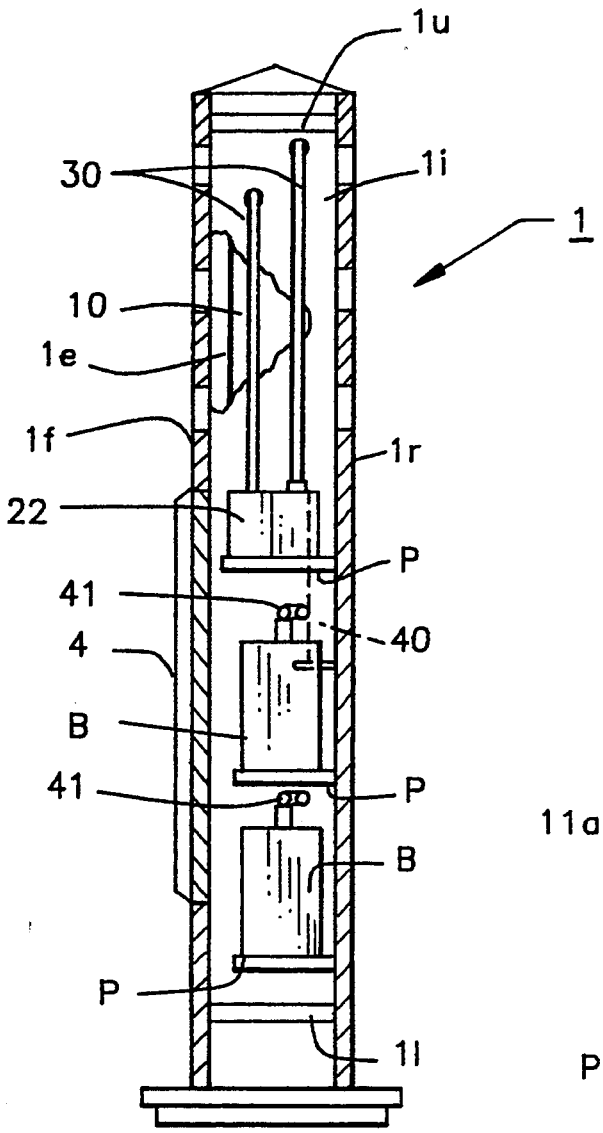
FIG. 4 is a schematic cross-sectional view taken along the lines 4–4 of FIG. 3.
Figure 4A:
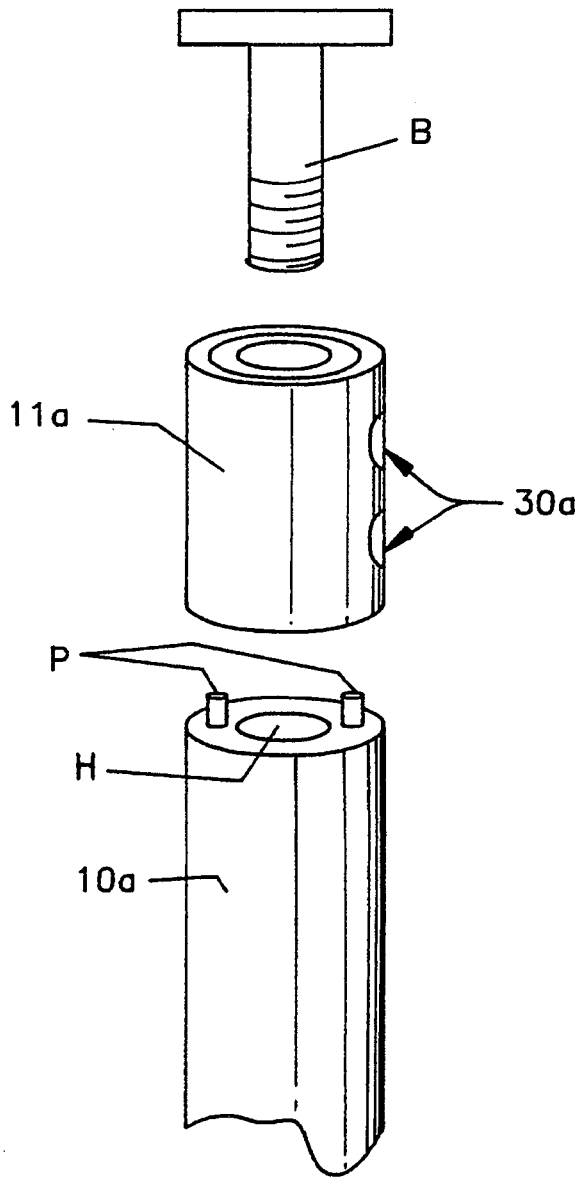
FIG. 4A is a diagrammatic frontal view of a gate actuator mounted for rotation on a stationary post.

As seen in FIG. 4A, an actuator 11*a* may be supported on a post 10*a* with its inner stationary portion mated to locator pins P and secured to the post via threaded bolt B threaded into threaded hole H, thus leaving outer portion of actuator with fluid ports 30*a* to rotate with the gate 1 and hydraulic fluid lines 30.

Figure 2:
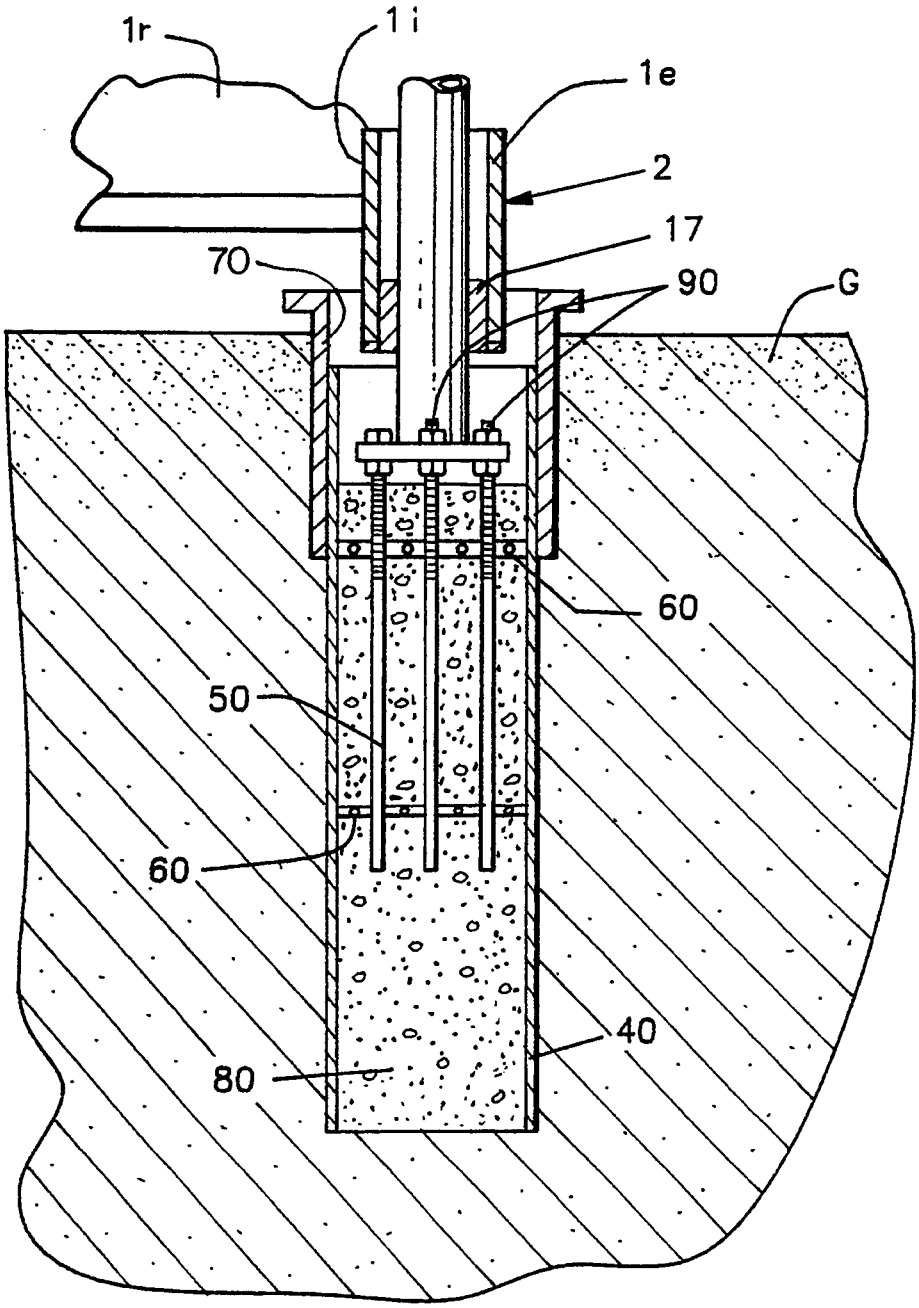
FIG. 2 is a schematic cross-sectional view of the post footing.

As seen in FIG. 2, the bottom of the post housing 2 provides an annular bushing 17 which accommodates both support and rotation of the gate about the post 10.

As further seen in FIG. 2, to install the post footings a hole is first dug in the ground G and tube 40, preferably made of biodegradeable cardboard, inserted. Within the tube are a plurality of metal rods 50 positioned with porous or wired spacers 60. Concrete 80 is then poured into the tube leaving the upper threaded ends 90 of the rods exposed. When the concrete is hardened, the bottom flange 10*a* of the post may then be bolted to the rods thus mounting the entire gate assembly in one operation. A metal collar 70 may be provided about the top of the tube, with the upper flared end at ground level, if the post is to be mounted below ground level.

Referring again to FIGS. 3 and 4, the other operational components of the gate system, as well as the actuator in the integral post housing, are shown supported within the gate between the front and back sides of the gate and between the proximal and distal ends thereof, the distances between the sides and ends being sized to accommodate them. The proximal end wall and distal end wall (not shown) and inner end wall at the proximal end along with the upper and lower connecting walls 1*u* and 1*l* (FIG. 4) retain the spaced relation between the front and rear sides.

The actuator 11 which is hydraulic in the embodiment disclosed, is connected to a hydraulic fluid reservoir 22, mounted within the confines of the sides of the gate on one of the platforms P provided within the gate confines, or within a chamber as may be fabricated as part of the gate, via hydraulic lines 30. As the entire gate rotates with the actuator, the provision of the reservoir support remote from the actuator, but within the gate itself, makes for a variety of component layout designs and facile manufacturing procedures as well as easy access for repair, if needed.

A microprocessor controller 40 responds to external control by governing the application of electric power to the actuator pump 23 which may be located within the reservoir itself if it is of a submersible design. Power is stored in batteries B as insurance against external power failure. Solar cell panels 5 may be mounted on the gate and wired to charge the batteries and may provide access to the components within the gate. Conventionally, access panels may be used with or instead of the solar panels; either being architecturally acceptable.

The battery power source and the controller are connected via electrical connectors 41. The controller is provided with output terminals 42 to connect to the various system components under the controllers's command. The wiring (not shown) of the actuator pump 23, solar cells 16, and antenna 10 are conventional. The solar charging circuitry may be a separate module within the gate or may be integrated into the controller 40. Likewise, the remote control receiver circuitry may also be a separate module or integrated into the controller.

Also not shown is the wiring leading from the controller to the position sensor S. The position sensor allows the controller 40 to sense the position of the gate by feeding the controller data as to the relative angular position of the post 10 to the post housing which rotates with the body of the actuator 11.

In addition, the controller may be programmed to perform a number of tasks relating to the condition of the gate, such as controlling the traffic signals 3, diagnosing the internal circuitry of the system, or monitoring the hydraulic pressure to the actuator 11 to determine if an object is blocking the movement of the gate. These, as well as other uses of the controller are more fully described in my earlier U.S. Pat. No. 4,916,859. The controller may receive information from the various system components via standard parallel or serial ports or, for that matter, by one or more terminals hardwired to the microprocessor's interrupts.

It can now be seen that this self-contained modular design permits the installation of a sophisticated gate system requiring no more than the pouring of a concrete footing or footings, the mounting of the post and gate assembly to the footing, and the linking of the necessary electrical connections. The entire operation may be conducted in a single weekend with the bulk of the time expended in waiting for the poured concrete footing to harden.

In addition, the controller can be easily accessed by removing a panel on the gate. There is sufficient space within the gate to permit the addition of other devices, such as the aforementioned solar cell recharging option. Hence, no major components need be disassembled or replaced in order to repair or upgrade the system.

It is also contemplated that the gate may be blow-molded as a single plastic unit in an operation that would create the necessary cavities to install the components. In such an operation, one cavity could act as the fluid reservoir itself and thereby obviate the need to install one.

As above noted, traffic signals 3 may be incorporated into the distal end of the gate and controlled, such that a red light will appear when the gate is opening and closing, a green light when the gate is fully open, and a yellow when the gate is about to close. A line may be painted across the roadway to indicate where traffic should stop to avoid being struck by the swinging gate.

The operation of the lock rod 5 is designed to drop the rod down into a hole in the road when the gate closes to prevent the gate from being forced. This may be effected by any mechanical or electromechanical mechanism such as an electric motor and a rack and pinion 100 within a cavity in the distal end of the gate with appropriate circuitry to the microprocessor.

Despite the traffic signals, caution dictates that the gate may strike something or someone. Hence, a sensor bar 6, not unlike those used on elevator doors may be provided. Such devices are, in fact, already used on powered gates. An alternative is an infra-red or ultrasonic detector which, unlike a sensor bar, may stop the gate before actual contact with an obstruction. In either case, circuitry between the microprocessor and sensor/detector is provided.

Lastly, it is preferred that the gate be molded of recycled plastics or an engineered plastic, such as Azdel.

It should be noted that there may be a number of ways to achieve the objects of the present invention and that therefore the invention is to be limited only by the scope of the claims herein.

I claim:

1. A gate having spaced apart front and rear sides, integral proximal and distal end walls separating said sides and an internal wall spaced from said proximal end wall, said front and rear sides and said proximal and internal walls defining a gate post housing, a gate post having an upper end and a lower end extending along vertical axis within said gate post housing, means for supporting said gate on said gate post for pivotal movement about said vertical axis of said gate post, said gate supporting means including a gate actuator having a mounting plate and a rotational body, said mounting plate comprising means secured to one of said ends of said gate post within said gate post housing for mounting said gate actuator on said gate post, said rotational body of said gate actuator including means for rotating said rotational body about said vertical axis of said gate post, means connecting said rotational body and said gate post housing for supporting said gate on said gate actuator and for rotating said gate about said gate post, said spaced apart front and rear sides defining area means remote from said gate post housing for supporting operating components of said gate.

2. The gate system of claim 1 wherein a wall closes the proximal end of said gate, said proximal end of said gate comprising a housing for said post and said actuator.

3. The gate system of claim 1 wherein means are provided at the bottom of said post for securing said gate assembly to a footing.

4. The gate assembly of claim 1 wherein said actuator is hydraulically driven and a hydraulic reservoir is supported between said gate sides.

5. The gate assembly of claim 1 wherein controller means for controlling gate operations are supported between said gate sides.

6. The gate assembly of claim 5 further comprising position sensor means for sensing relative angular position data of said post to said gate and transmitting said position data to said controller means, said position sensor means being supported between said gate sides.

7.The gate assembly of claim 5 further comprising antenna means for receiving remote control command data and transmitting said command data to said controller means.

8. The gate assembly of claim 5 further comprising traffic signal means disposed on said gate for receiving information from said controller means and for signalling the operations of said gate system.

9. The gate assembly of claim 5 further comprising: collision detection means disposed on said gate for detecting an actual or impending collision with an obstruction and transmitting the detected information to said controller means.

10. The gate assembly of claim 5 further comprising:
a retractable rod;
means for operating said rod supported between said sides at the distal end of said gate;
said operating means retracting said rod when said gate is in an open position and extending said rod when said gate is in a closed position; and
means for transmitting retracting and extending commands from said controller means.

11. The gate assembly of claim 5 further comprising power source means supported between said sides for transmitting power to operating components in said gate.

12. The gate assembly of claim 11 further comprising:
solar cell means mounted on the outside of said gate for directing electrical power to said power source means.

13. The gate assembly of claim 12 wherein said power source means comprise at least one solar cell panel.

14. The gate assembly of claim 13 wherein said solar cell panel is a panel providing access to operating components in said gate assembly.

15. A gate having spaced apart front and rear sides and integral proximal and distal walls separating said sides, said front and rear sides and said integral proximal and distal walls defining area means for housing operating components for said gate, a gate post, having an upper end and a lower end extending between said sides along a vertical axis, means for supporting said gate upon said gate post between said sides for rotation of said gate about said vertical axis of said post, means at said lower end of said post for securing said post to a footing, a gate actuator secured to said upper end of said gate post between said sides and including means for rotating about said vertical axis of said gate post, and means connecting said rotating means and at least one of said sides and said walls for supporting said gate on said gate actuator and for pivoting said gate about said gate post.

* * * * *